United States Patent [19]

Murayama

[11] Patent Number: 4,756,443

[45] Date of Patent: Jul. 12, 1988

[54] PRESSURE-PACKING CONTAINER WITH EASY-TO-OPEN CLOSURE

[75] Inventor: Tatsuyoshi Murayama, Nagaoka, Japan

[73] Assignee: Vilamonte Research & Development Co., Ltd., Niigata, Japan

[21] Appl. No.: 83,715

[22] Filed: Aug. 10, 1987

[51] Int. Cl.[4] ..... B65D 41/32

[52] U.S. Cl. ..... 220/270; 220/260

[58] Field of Search ..... 220/260, 270, 276

[56] References Cited

U.S. PATENT DOCUMENTS 4,211,336 7/1980 Helms ..... 220/270
4,440,310 4/1984 Heyn ..... 220/270
4,548,333 10/1985 Kobayashi et al. ..... 220/276

FOREIGN PATENT DOCUMENTS 56-28787 7/1981 Japan .

*Primary Examiner*—George T. Hall
*Attorney, Agent, or Firm*—Bruce L. Adams; Van C. Wilks

[57] ABSTRACT

A pressure-packing container comprises an impervious container body having an internally recessed upper edge, and an easy-to-open closure cap composed of a rigid outer closure member having an annular rim, a resilient inner closure member joined with the underside of the outer closure member, and a sheet of impervious film bonded with the inner closure member. To close the container, an inner peripheral wall of the rim is plastically deformed to force a portion of the inner closure member to flex into a groove in the upper edge, with an outer edge of the impervious film sheet sandwiched between the deformed inner closure member and the grooved upper edge, thereby providing a hermetic seal strong enough to withstand the inside pressure of the container.

16 Claims, 5 Drawing Sheets

PRESSURE-PACKING CONTAINER WITH EASY-TO-OPEN CLOSURE

BACKGROUND OF THE INVENTION

1. Field of the Invention

The present invention relates generally to containers, and more particularly to a wide-mouthed container with an easy-to-open closure used for pressure packing of various liquid, solid and semisolid products, such as beer, carbonated soft drink and tennis balls.

2. Prior Art

There are known various types of wide-mouthed containers used for pressure packing of beer, carbonated soft drink, tennes balls and the like. The known containers generally comprise a pressure-resistant, impervious container body composed of a can, bottle or jar, and a closure for closing an opening or mouth of the container body.

The glass bottle is closed with a crown cap which is lined with a cork or a thin film of rubber like composition. When the edge of the crown cap is crimped over the mouth of the bottle, the cork or rubber composition provides a tight, gasket-like seal. To open the bottle, a cap-opener is necessay.

The can is made of tin-coated steel plate or aluminum plate. The thin-coated steel can body is side-seamed and flanged at both ends. Then one end of the can body is sealed with an end disk; the other end is sealed when the can is filled. On the other hand, the aluminum can body is drawn from a can blank into a generally cup shape having a flange at its open end. For packing, each of the can bodies is closed with an end disk having a curled rim which is machine-folded with the end flange of the can body. When the can is to be opened, a tedious operation is necessary because a can-opener is still required. The can thus opened is not reusable without reconstruction. Consequently, most used can bodies are recovered for re-casing, however, this recycling system requires additional cost. The rest of the used can bodies are simply dumped, which leads to an environmental polution and waste of raw materials.

With the foregoing drawbacks in view, the present inventor has proposed a wide-mouthed container having an easy-to-open closure. The proposed closure, as disclosed in Japanese patent publication No. 56-28787, is composed of a rigid outer closure member and a resilient inner closure member joined together by a series of narrow connector portions extending through small apertures in the outer closure member and interconnecting the inner closure member and a narrow strip overlying the obverse side of the outer closure member. To close the container, the edge of the outer closure member is crimped over the mouth of a container body so as to provide a hermetic seal between the inner closure member and the container body. When the container is to be opened, the strip is pulled to separate the outer closure member from the inner closure member, thereby detaching the inner closure member from the container body.

The container thus constructed is advantageous in that with the provision of the resilient inner closure member, the container body is free from damage and hence is reusable. However, the container has a drawback that the inner closure member exposed to a pressurized gas in the container is not fully impervious to gas, allowing leakage of the pressurized gas therethrough from the container. With this leakage, degrading of the packed product would result.

SUMMARY OF THE INVENTION

It is accordingly a general object of the present invention to overcome or substantially eliminate the foregoing difficulties of the prior containers while keeping the adavantages of the same.

A more specific object of the present invention is to provide a pressure-packing container incorporating structural features which provides a hermetic seal strong enough to withstand the interior pressure of the container.

According to the present invention, the foregoing and other objects of the present invention are attained by a pressure-packing container which comprises a container body having an opening and a recessed inner peripheral portion disposed adjacent to the opening, and a closure cap adapted to be attached to the container body for closing the opening, the closure cap including a rigid outer closure member having an upwardly projecting rim defining a downwardly open annular groove for receiving a peripheral edge of the container body defining the opening, and a resilient inner closure member joined with the underside of the outer closure member and extending at least along an inner peripheral wall of the rim, the inner closure member having an impervious surface layer sealingly engageable with the peripheral edge of the container body, the inner peripheral wall of the rim being plastically deformable radially outwardly to urge the inner closure member to resiliently flex into the recessed inner portion of the container body, thereby providing a hermetic seal between the container body and the closure cap.

With this construction, the impervious surface layer of the inner closure member is sealingly pressed against the inner surface of the peripheral wall of the container body as the inner closure member is resiliently deformed into the recessed inner peripheral portion. The impervious surface layer thus fitted provides a hermetic seal strong enough to withstand the interior pressure of the container.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
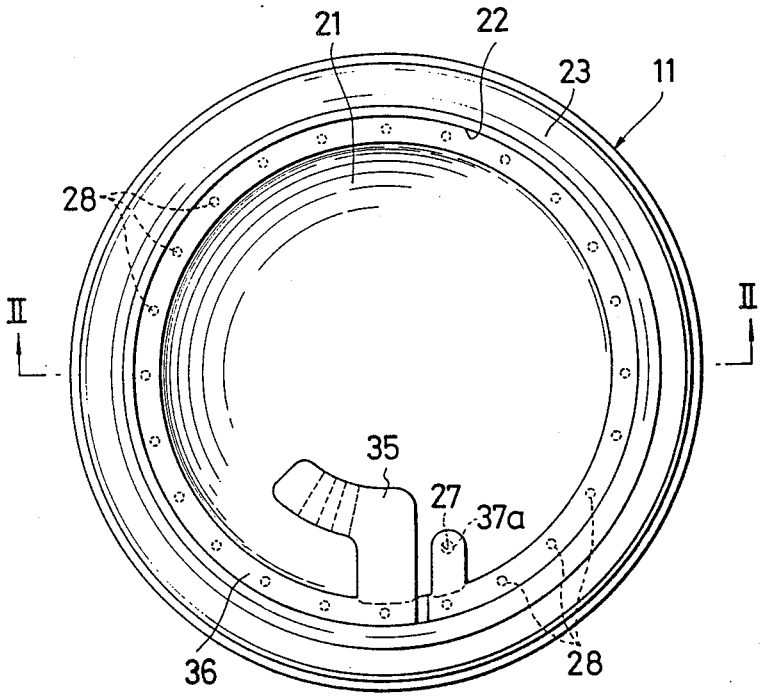
FIG. 1 is a plan view of a closure cap of a pressure-packing container embodying the present invention.
Figure 2:
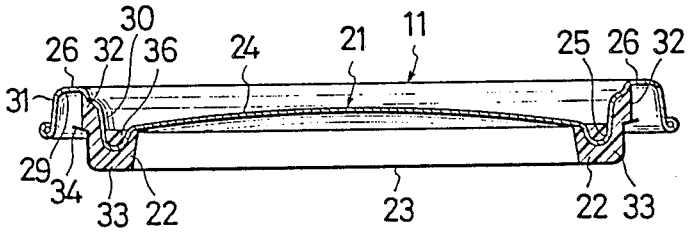
FIG. 2 is a cross-sectional view taken along line II—II of FIG. 1.
Figure 3:
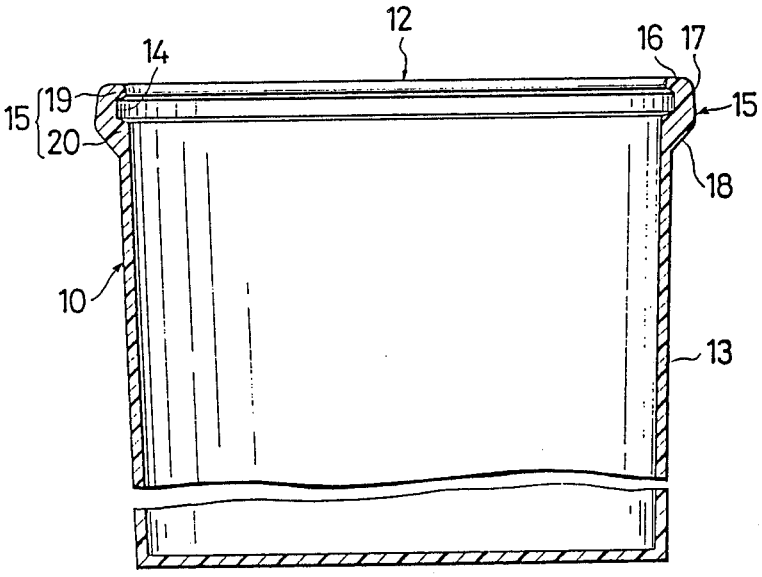
FIG. 3 is a fragmentary longitudinal cross-sectional view of a container body of the container.

FIGS. 1 through 5 show an embodiment of the present invention. As shown in FIGS. 2 and 3, a container embodying the invention is composed of a container body 10 and a closure cap 11 adapted to be attached to the container body 10 to sealingly close an opening 12 of the container body 10.

The container body 10, as shown in FIG. 3, has a generally cup shape and is molded of pressure-resistant, impervious synthetic resin. The cup-shaped container body 10 includes a peripheral wall 13 and a recessed inner peripheral portion 14 defined in the peripheral wall 13 adjacent to the opening 12. The recessed inner peripheral portion 14 comprises an annular groove extending along an upper edge 15 of the peripheral wall 13. The upper edge 15 is thickened and includes a flat upper surface 16 extending perpendicularly to the axis of the cup-shaped container body 10, a sloped outer peripheral surface 17 extending downwardly divergently from the flat upper surface 16, and an inclined lower surface 18 extending downwardly convergently from the outer peripheral surface 17. The thickened upper edge 15 of the peripheral wall 13 has an upper portion 19 disposed above the groove 14 and a lower portion 20 disposed below the groove 14. The lower portion 20 has an inside diameter smaller than that of the upper portion 19 for purposes described below.

As shown in FIGS. 1 and 2, the closure cap 11 includes a rigid outer closure member 21, a resilient inner closure member 22 joined with the underside of the outer closure member 21 and extending over a limited area of the outer closure member 21, and a sheet of impervious film 23 overlying the inner closure member 22.

The outer closure member 22 is press-formed from a tin-coated steel plate and includes a circular central portion 24, an annular recessed intermediate portion 25 extending around the central portion 24, and an upwardly projecting annular rim 26 extending around the recessed intermediate portion 25. The central portion 24 is slightly curved outwardly and has a through-hole 27 (FIG. 1) disposed closer to the recessed intermediate portion 25 than to the center of the closure cap 11. The recessed intermediate portion 25 has a plurality of apertures 28 (FIGS. 1 and 4) circumferentially spaced at equal angular intervals. The apertures 28 have a diameter smaller than the diameter of the through-hole 27. The recessed intermediate portion 25 is in the form of a downwardly projecting annular rib which reinforces the mechanical strength of the outer closure member 21. The annular rim 26 defines a downwardly open annular groove 29 for receiving therein the thickened upper edge 15 of the container body 10. The annular rim 26 includes an inner peripheral wall 30 contiguous to the recessed intermediate portion 25, and an outer peripheral wall 31 remote from the recessed intermediate portion 25 and engageable flatwise with the outer peripheral surface 17 of the upper edge 15 of the container body 10. The inner peripheral wall 30 is arcuate and swelled outwardly. The outer peripheral wall 31 is flared downwardly and is complementary in contour to the outer peripheral surface 17.

The resilient inner closure member 22 is made of synthetic resin, preferably low-density polyethylene and is molded integrally with the rigid outer closure member 21. The inner closure member 22 includes an annular upper portion 32 disposed in the annular groove 29 of the rim 26 and extending around the inner peripheral wall 30 of the rim 26, and an annular lower portion 33 integral with the upper portion 32 and extending over and around the underside of the recessed intermediate portion 24 of the outer closure member 21. The lower portion 33 has an outside diameter substantially the same as, and preferably slightly larger than, the inside diameter of the lower portion 20 of the upper edge 15 of the container body 10. The upper portion 32 has an outside diameter larger than that of the lower portion 33 and is sealingly engageable with the upper portion 19 of the upper edge 15. The upper portion 32 is upwardly tapered away from the lower portion 33 in such an manner that the upwardly tapered upper portion 32 is normally partially receivable in the annular groove 14 in the container body 10, as shown in FIG. 4.

Figure 4:
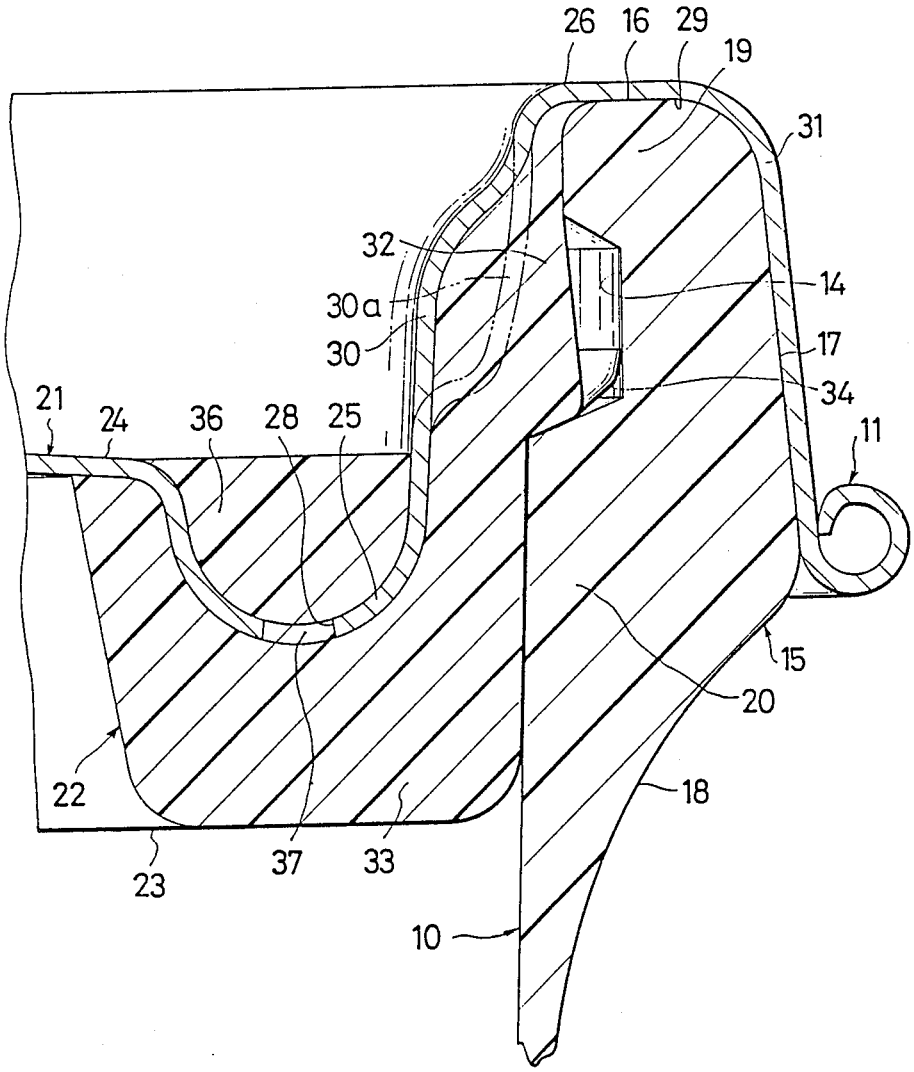
FIG. 4 is an enlarged cross-sectional view of a part of the container, showing a manner in which the closure cap is attached to the container body.

The impervious film sheet 23 made preferably of a resin-bonded aluminum foil sheet is bonded with the bottom surface of the inner closure member 22 and extends over the outer peripheral wall of the inner closure member 22 to such an extent that an outer edge portion 34 of the impervious film sheet 23 overlies part of the outer portion 32 of the inner closure member 32 as shown in FIG. 4. The impervious film sheet 23 is separated from the central portion 24 of the outer closure member 21. It is possible, according to the present invention, to replace the impervious film sheet 23 with an impervious surface layer of the inner closure member 22 per se.

As shown in FIG. 1, the closure cap 11 further includes a pull tab 35 disposed on an outer obverse side of the outer closure member 21 for detaching the closure cap 11 from the container body 10. The pull tab 35 is integrally connected with an annular strips 36 disposed in the recessed intermediate portion 25 of the outer closure member 21. The annular strip 36 in turn is integrally connected with the resilient inner closure member 22 by means of a plurality of connectors 37 (FIG. 4) extending through the respective apertures 28 and the through-hole 27. The connector 37*a* extending through the through-hole 27 is thicker than the other connectors 37 and hence is stronger than the latter. The pull tab 35, the strip 36 and the connectors 37, 37*a* are composed of the same material as the inner closure member 22 and they are formed simultaneously with the formation of the molded inner closure member 22.

Figure 5:
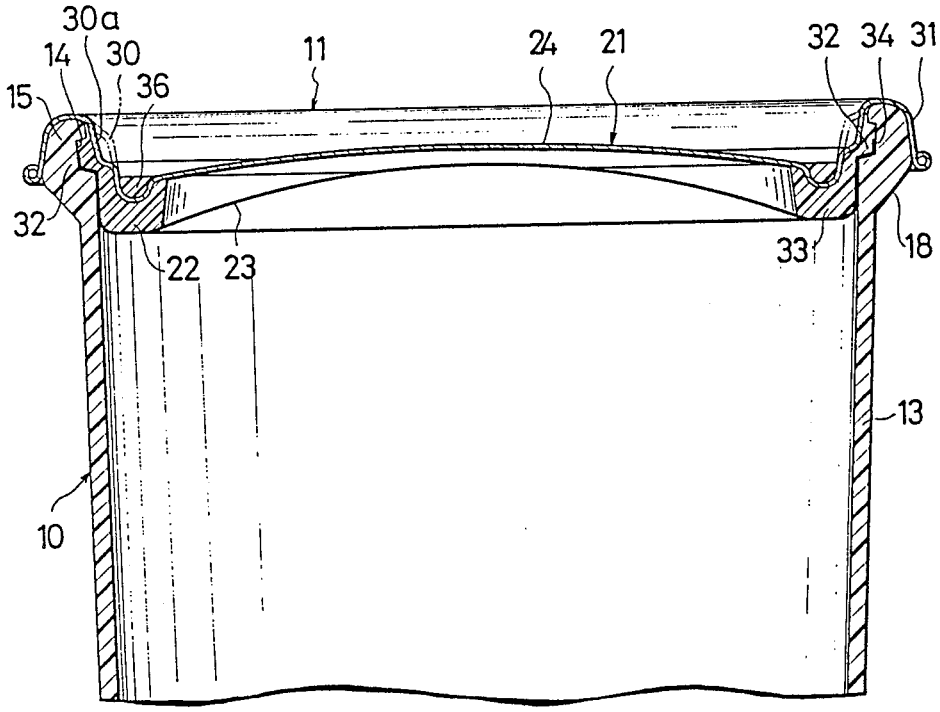
FIG. 5 is a fragmentary longitudinal cross-sectional view of the contaienr with the closure cap attached to the container body.

The container of the foregoing construction is particularly suitable for use in pressure packing of various products, such as beer, carbonated soft drink, and tennis balls. The opening 12 of the container body 10 is sealed when the container is filled. For packing, the closure cap 11 is first fitted over the upper edge 15 of the container body 10 as shown in FIG. 4. In this instance, the upper portion of the inner closure member 22 and the impervious film sheet 23 are held in sealing engagement respectively with the upper and lower portions 19, 20 of the upper edge 15, with a lower part of the upper portion 32 and the outer edge 34 of the impervious film sheet 23 received in the groove 14 in the upper edge 15. The outer peripheral wall 31 of the rim 26 extends flatwise over the outer peripheral surface 17 of the upper edge 15. Then the inner peripheral wall 30 of the rim 26 is plastically deformed readially outwardly toward the outer edge 15 until the inner peripheral wall 30 assumes a substantially vertically extending disposition indicated by the phantom lines 30*a*. With this plastic deformation of the inner peripheral wall 30, the upper portion 32 of the resilient inner closure member 22 is forced to flex into the groove 14 to such an extent that the groove 14 is completely filled with the resilient upper portion 32 with the impervious film sheet edge 34 sandwiched between the deformed upper portion 32 and the upper edge 15, as shown in FIG. 5. The container has now been sealed completely.

During forcible deformation of the upper portion 32, a mass of the upper portion 32 can reliably be guided into the groove 14 due to initial reception of part of the upper portion 32 in the groove 14. Such initial reception is effected partly because the upwardly tapered, large-diameter upper portion 32, and partly because the small-diameter lower portion 20 of the upper edge 15. Since the inner peripheral wall 30 is initially swelled outwardly, the upper portion 32 of the inner closure member 22 has a mass large enough to fill the groove 14 when the inner peripheral wall 30 is deformed.

The impervious film sheet 23 exposed to the interior of the container prevents leakage of a pressurized gas from the container, thereby protecting the packed product from degrading. Since the outer edge 34 of the impervious film sheet 23 and the upper portion 32 of the inner closure member 22 are held in interlocking engagement with the grooved upper edge 15 of the container body 10, the closure cap 11 provides a hermetic seal strong enough to withstand the inside pressure of the container. Furthermore, the impervious film sheet 23 underlies the outer closure member 21 with a space leaving therebetween, so that the outer closure member 21 is not subjected to the inside pressure tending to open the closure cap 11. The inside pressure applied to the impervious film sheet 23 is not transmitted to the outer closure member 21 but retained mainly by the portions 32, 34 held in locking engagement with the grooved upper edge 15 of the container body 10. With the space defined between the outer closure member 21 and the impervious film sheet 23, it is possible to provide an aperture in the central portion 24 of the outer closure member 21 as occasion demands.

To open the container of FIG. 5, the pull tab 35 is gripped by the user's fingers and pulled upwardly away from the closure cap 11 to thereby forcibly separate the strip 36 from the successive connectors 37. Since the last connector 37*a* is thicker than the remainder 37 and hence withstands the pulling force, the pull tab 35 is still in integral connection with the inner closure member 22. As the pull tab 35 is further pulled, the outer closure member 21 is separated from the inner closure member 22, followed by detachment of the inner closure member 22 from the upper edge 15 of the container body 10. In this instance, the closure cap 11 is snapped out from the container body 10 under the force of the pressurized gas in the container. The upper edge 15 of the container body 10 is free from damage and hence is reusable after cleaning.

Figure 6:
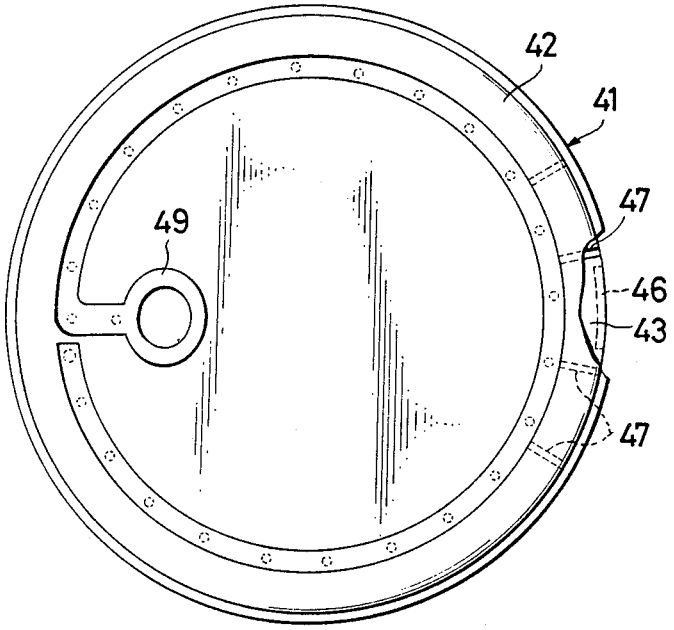
FIG. 6 is a view similar to FIG. 1, showing a modified closure cap.
Figure 7:
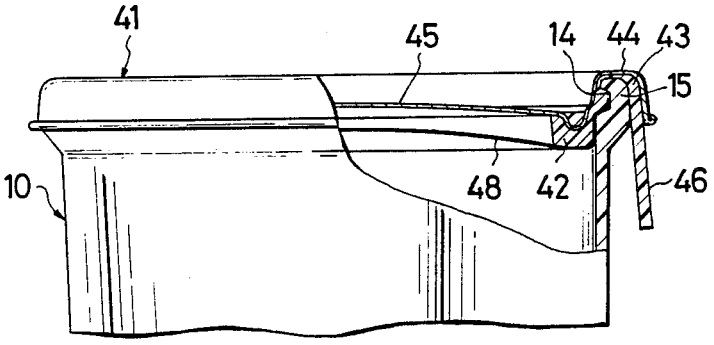
FIG. 7 is a fragmentary front elevational view, partly in cross section, of a container having the closure cap of FIG. 6.

FIG. 6 shows a modified closure cap 41 according to the present invention. The closure cap 41 is similar to the closure cap 11 of the foregoing embodiment but differs therefrom in that the resilient inner closure member 42 has a grip portion 43 extending over the extire region of the underside of an annular rim 44 of the rigid outer closure member 45 so as to embrace the upper edge 15 of the container body 10, as shown in FIG. 7. The inner closure member 42 includes an elongate flap 46 formed integrally with and extending downwardly from the outer edge of the grip portion 43, and a plurality (four shown in FIG. 6) of radial slits 47 extending in an outer peripheral portion of the inner closure member 42 and located adjacent to the flap 46. The slits 46 extend inwardly from the outer edge of the grip portion 43 and terminate shot of the groove 14 in the upper edge 15. The bottom end of the inner closure member 42 has bonded thereto a sheet of impervious film 48 sealingly engageable with the inner surface of the upper edge 15. The impervious film sheet 48 has an outer edge sealingly engageable with the groove 14 in the upper edge 15.

The closure cap 41 of the foregoing construction is attached to the upper edge 15 of the container body 10 in the same manner as the closure cap 11 of FIG. 1 has done, therefore, a description is not necessary. When the closure cap 41 is to be detached from the container body 10, the flap 46 is lifted up to move a portion of the rim 44 upwardly away from the corresponding slit grip portion 44 of the inner closure member 42. As the flap 46 is further lifted, the inner closure member 42 and the impervious film sheet 48 are brought out of sealing engagement with the grooved upper edge 15 of the container body 10. In this instance, a pressurized gas leaks from the container through the slits 47. A further upward movement of the flap 46 necessarily causes detachment of the closure cap 41 from the container body 10. Alternately, it is possible to open the container by pulling a pull tab 49 on the closure cap 41, in advance to the lifting of the flap 46.

Obviously, many modifications and variations of the present invention are possible in the light of the above teachings. For instance, the container body 10 may be of the disposable type made of laminated paper or other impervious flexible material. Furthermore, the opening 12 of the container body 10 may be trianglular or polygonal in shape. It is therefore to be understood that within the scope of the appended claims, the invention may be practiced otherwise than as specifically described.

What is claimed is:

1. A pressure-packing container comprising:

(a) a container body having an opening and a recessed inner peripheral portion disposed adjacent to said opening; and (b) a closure cap adapted to be attached to said container body for closing said opening, said closure cap including (i) a rigid outer closure member having an upwardly projecting rim defining a downwardly open annular groove for receiving a peripheral edge of said container body defining said opening, and (ii) a resilient inner closure member joined with the underside of said outer closure member and extending at least along an inner peripheral wall of said rim, said inner closure member having an impervious surface layer sealingly engageable with said peripheral edge of said container body, said inner peripheral wall of said rim being plastically deformable radially outwardly to urge said inner closure member to resiliently flex into said recessed inner portion of said container body, thereby providing a hermetic seal between said container body and said closure cap.

2. A pressure-packing container according to claim 1, said recessed inner peripheral portion having an annular groove extending along said peripheral edge of said container body.

3. A pressure-packing container according to claim 1, said peripheral edge of said container body having a first portion disposed on one side of said recessed inner peripheral portion close to said opening, and a second portion disposed on the other side of said recessed inner peripheral portion remote from said opening, said second portion having an inside diameter smaller than that of said first portion.

4. A pressure-packing container according to claim 1, said inner closure member including an upper portion and a lower portion contiguous to said upper portion and having an outside diameter smaller than that of said upper portion, said upper portion being tapered upwardly away from said lower portion and normally partly receivable in said recessed inner peripheral portion.

5. A pressure-packing container according to claim 1, said inner peripheral wall of said rim being arcuate and normally swelled outwardly.

6. A pressure-packing container according to claim 1, said inner closure member being made of synthetic resin.

7. A pressure-packing container according to claim 6, said inner closure member being molded of low-density polyethylene.

8. A pressure-packing container according to claim 6, said inner closure member being integrally molded with said outer closure member.

9. A pressure-packing container according to claim 1, said impervious surface layer of said inner closure member comprising a sheet of impervious film bonded with said inner closure member.

10. A pressure-packing container according to claim 9, said impervious film sheet having an outer edge receivable in said recessed inner portion of said container body.

11. A pressure-packing container according to claim 9, said impervious film sheet being spaced from said outer closure member.

12. A pressure-packing container according to claim 9, said impervious film sheet being made of a resin-laminated aluminum foil sheet.

13. A pressure-packing container according to claim 1, said outer closure member including an outwardly curved central portion and a recessed intermediate portion extending around said central portion and interconnecting said central portion and said rim, said recessed intermediate portion being arcuate shape in cross section and having a plurality of apertures, said inner closure member being made of synthetic resin and integrally molded with said outer closure member, said closure cap further including a pull tab disposed on the upper side of said outer closure member, and a plurality of connectors extending respectively through said apertures and interconnecting said pull tab and said inner closure member.

14. A pressure-packing container according to claim 12, said impervious surface layer comprising a sheet of impervious film bonded with the underside of said inner closure member and spaced from said central portion of said outer closure member.

15. A pressure-packing container according to claim 14, said impervious film sheet having an outer edge receivable in said recessed inner periphral portion of the container body.

16. A pressure-packing container according to claim 1, said inner closure member extending over the entire region of the underside of said rim for sealingly enbracing said peripheral edge of said container body, said inner closure member including an elongate flap integral with and extending downwardly from an outer edge of said inner closure member, and a plurality of radial slits disposed adjacent to said lug.

* * * * *